US005688190A

United States Patent [19]

Rowland et al.

[11] Patent Number: 5,688,190

[45] Date of Patent: Nov. 18, 1997

[54] REMOVABLE ADHESIVE BACKED PADS FOR GOLF CLUB STRIKING SURFACES

[75] Inventors: Michael L. Rowland; David L. Ballard, both of Kingwood, Tex.

[73] Assignee: The Spin Doctor, Ltd., Kingwood, Tex.

[21] Appl. No.: 597,974

[22] Filed: Feb. 7, 1996

[51] Int. Cl.[6] ..... A63B 53/04

[52] U.S. Cl. ..... 473/330; 473/331; 473/342; 473/288

[58] Field of Search ..... 473/237, 288, 473/329, 330, 342, 331

[56] References Cited

U.S. PATENT DOCUMENTS

| | | | |
|---|---|---|---|
| 1,094,599 | 4/1914 | Samson . | |
| 2,447,967 | 8/1948 | Stone | 273/77 |
| 2,660,436 | 11/1953 | Grossman | 273/77 |
| 2,908,502 | 10/1959 | Bradstreet et al. | 273/167 |
| 3,273,891 | 9/1966 | Grim, Jr. | 273/163 |
| 3,310,309 | 3/1967 | Moss | 273/162 |
| 3,721,447 | 3/1973 | Louderback | 273/186 |
| 3,989,861 | 11/1976 | Rasmussen | 427/180 |
| 4,768,787 | 9/1988 | Shira | 273/175 |
| 4,917,384 | 4/1990 | Caiati | 273/175 |
| 4,964,641 | 10/1990 | Miesch et al. | 473/330 |
| 5,029,865 | 7/1991 | Kim | 273/175 |
| 5,033,746 | 7/1991 | Jones | 473/237 |
| 5,125,655 | 6/1992 | Crooks | 273/32 |
| 5,299,807 | 4/1994 | Hutin | 273/173 |
| 5,310,185 | 5/1994 | Viollaz et al. | 273/167 |
| 5,362,047 | 11/1994 | Shaw et al. | 273/77 |
| 5,425,538 | 6/1995 | Vincent et al. | 273/167 |
| 5,445,386 | 8/1995 | Marshall | 273/194 |

*Primary Examiner*—George J. Marlo

*Attorney, Agent, or Firm*—Pravel, Hewitt, Kimball & Krieger

[57] ABSTRACT

A device for use on a golf club having a substantially planer club face surface for striking a golf ball. The device is a two-sided removable pad having a ball contact surface on a first side which includes a plurality of ribs to impart back spin to a struck golf ball. Each rib has a multitude of peaks and valleys, each said valley connecting to an adjacent peak by an inclined surface and to another adjacent peak by a horizontal surface. The pad has an adhesive coating on a second side for temporary application to the golf club surface.

5 Claims, 2 Drawing Sheets

FIG.1
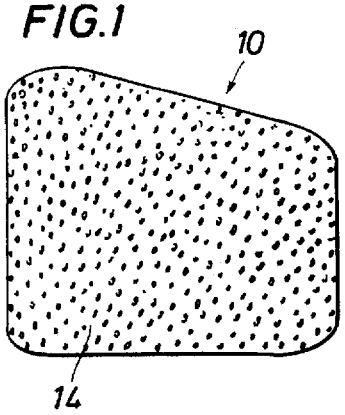
FIG. 2
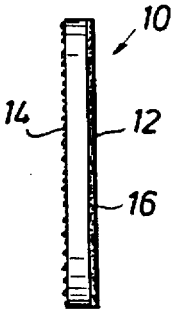
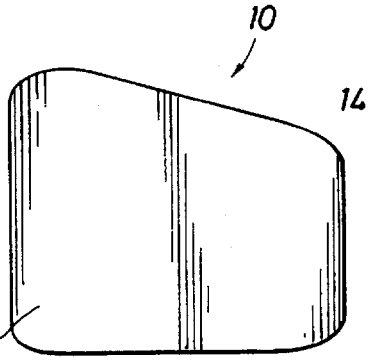
FIG. 3
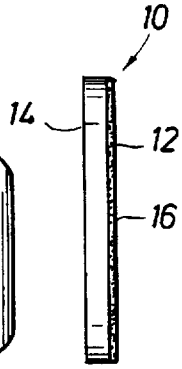
FIG. 4
FIG.5
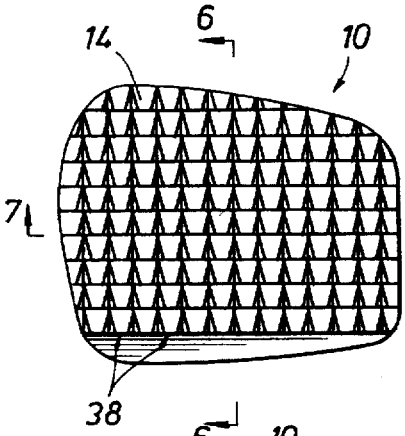
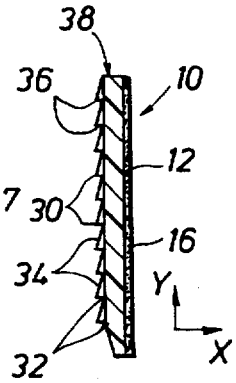
FIG. 6
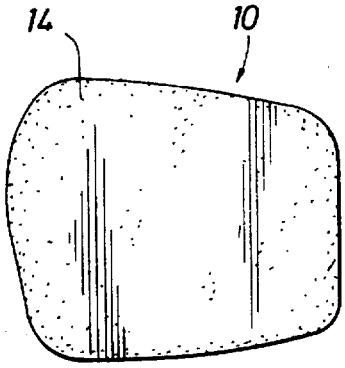
FIG. 8
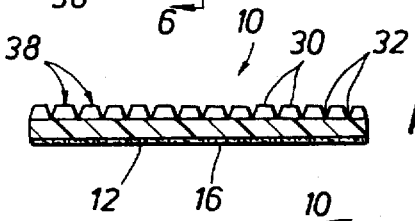
FIG. 7
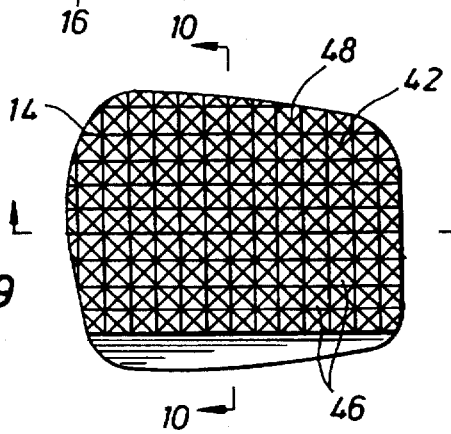
FIG. 9
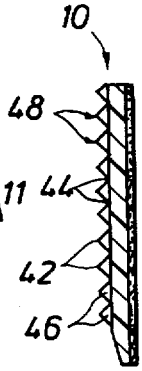
FIG. 10
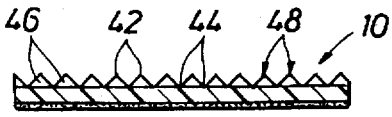
FIG. 11

FIG. 12
(PRIOR ART)
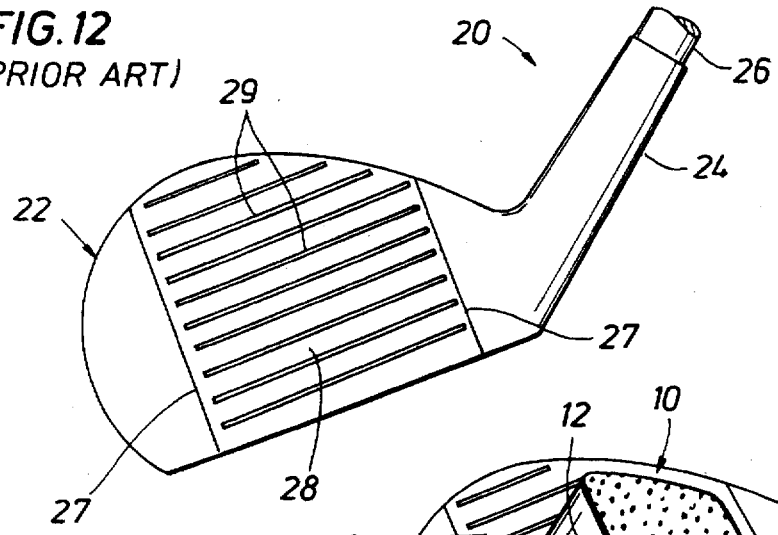
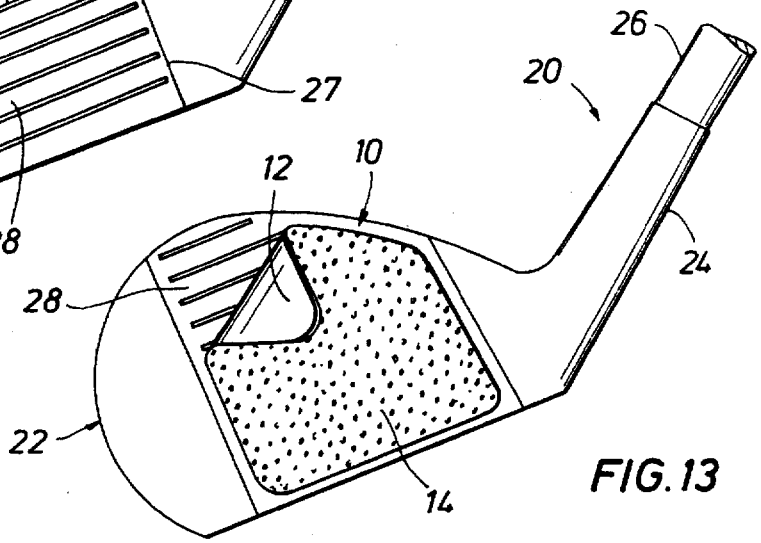
FIG. 13
FIG. 14
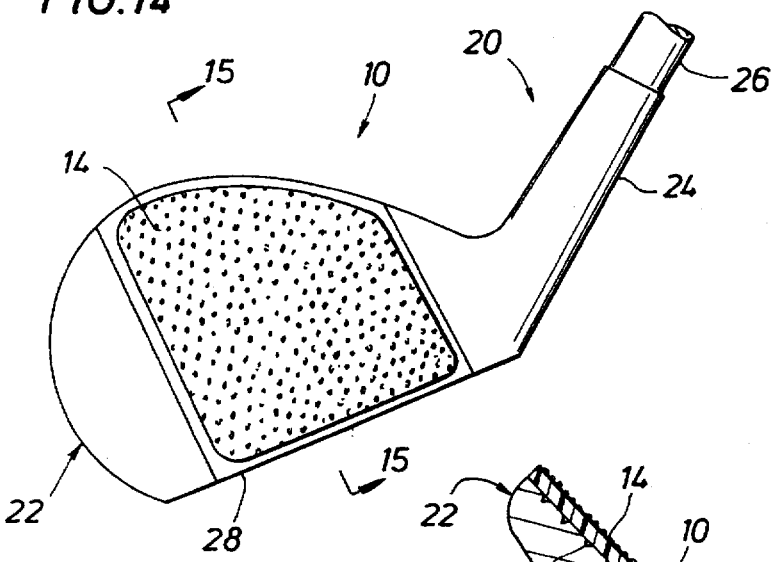
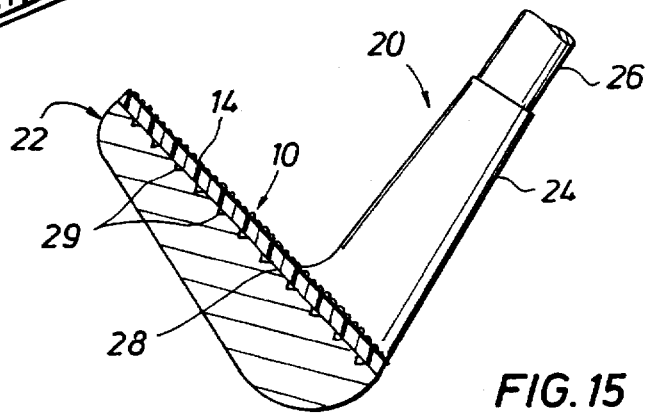
FIG. 15

REMOVABLE ADHESIVE BACKED PADS FOR GOLF CLUB STRIKING SURFACES

BACKGROUND OF THE INVENTION

1. Field of the Invention

The present invention relates in general to golf clubs and, in particular, to the head of a golf club having a substantially planar club face surface for striking a golf ball.

2. Description of the Prior Art

Most golf clubs, often referred to as irons and woods, have a substantially planar club face surface for striking a golf ball. Typically, this club face contains a frictional element or surface roughness that imparts a rotational spin to the golf ball upon contact. Excessive spin of the golf ball is not desirable on a drive since it may cause a slice or a hook. However, spin of the golf ball, preferably back spin, is desirable on shorter shots for controlling the ball's flight trajectory and for minimizing the hall's rolling distance after the ball lands on the green.

Typically, most golf clubs impart some form of spin. Even if the club face hits the ball flat, the horizontal and vertical grooves or other face irregularities on the striking face on the driver or woods may still impart a slight spin. Furthermore, those clubs with more loft such as the number 7, 8, 9 clubs and the wedges are intended to impart more back spin and increase the trajectory height of a ball in an effort to minimize the ball's rolling distance after it lands on the green. Again, to do this such clubs typically include horizontal grooves within the club face. Additionally, a grit containing hard particles or a coating of plastic adhesive may be applied to the club face to provide greater friction between the ball and the club face. Thus, a conventional golf club, particularly one for shorter shots, includes some combination of horizontal grooves and frictional finishes for imparting back spin to a golf ball.

Several disadvantages exist with the conventional golf club's grooves and frictional finishes. For example, the frictional finish's useful life may be relatively short. Once the coating wears off, the grooves provide the only practical means of introducing back spin. As a result, a golfer must periodically purchase a new club to maintain the proper frictional element on the club face. For most golfers, the grooves alone are insufficient for achieving the desired back spin.

Another disadvantage is that the frictional element of a new conventional golf club may be insufficient for the novice to obtain a desirable back spin. Most new golf clubs contain a standard degree of surface roughness. The standard roughness usually complies with the golf professionals' governing body, the United States Golf Association ("USGA"). The USGA's club roughness standard serves the useful purpose of assuring that all golfers participating in golf tournaments use similar type clubs. The USGA standards, however, are not particularly useful for the weekend golf warrior facing an island green with a conventional pitching wedge. As a result of conventional golf clubs complying with the USGA standard, many golfers need greater surface roughness on their club faces then presently available on new golf clubs.

Similarly, because a conventional golf club's surface roughness is standardized, it is difficult for one club surface to sufficiently accommodate all playing conditions and all golfers. For example, on a day when the greens are hard and dry, a golfer will need to put more backspin on the ball to make it stick on the green. Under such conditions, a golfer desires a club face surface with more roughness so the club imparts as much backspin as possible to the ball. In contrast, on a wet or damp day when the greens are soft and slow, a golfer will need less backspin and thus will need a less rough club face. Although a professional golfer is adept at using a single roughness club under varying course conditions, most golfers would prefer to have club faces with varying degrees of surface roughness to achieve a desired back spin under all conditions. Thus, a golfer must purchase several clubs, each for use under a different condition.

Prior patents have realized the advantages of greater surface roughness on the club face surface by adhering carbides and other hard particles to the striking surface of golf clubs. For example, in U.S. Pat. No. 4,917,384 to Caiati there is a disclosure of adhering diamond particles directly to the club face of a smooth driver face, that is, one without grooves. However, the Caiati golf club, like a conventional golf club, loses its surface roughness over time. Moreover, because the Caiati club face does not contain grooves, but rather is smooth prior to adhering particles, it is of little use to the golfer when the particles wear off. The golfer must either purchase a new golf club or adhere new diamond particles. Additionally, because the particles are permanently adhered to the club face, the golfer may need to purchase several clubs of differing roughness to achieve a desired back spin. See also Australian Patent Specification No. 268181.

Similarly, U.S. Pat. No. 4,768,787 to Shira discloses embedding hard particles into the golf club face. Although embedding particles has the advantage of longer roughness life then adhering particles to the golf club face, it still suffers from the disadvantage of requiring the golfer to purchase several different clubs of varying roughness.

It would be desirable to have a more consistent striking surface for a conventional golf club that provides a preferred frictional element.

SUMMARY OF THE INVENTION

The present invention is a removable adhesive back pad which provides a golf club face with a preferred frictional surface for engaging a golf ball. Depending on the circumstances, the frictional surface may serve to minimize rotation for the woods and longer irons while maximizing back spin for the shorter irons and wedges. The use of the pad does not permanently alter the face of a conventional golf club. Moreover, removal of the pad is easy and convenient. The pad includes an adhesive surface for applying the pad to the golf club face and a striking surface for contacting the struck golf ball.

The pad is applied to the desired golf club by pressing the adhesive surface firmly against the club face. The installed pad is easily removed by peeling it off the club face. Thus, the pad may be easily replaced when it wears out or if a pad of a different roughness is desired.

BRIEF DESCRIPTION OF THE DRAWINGS

A better understanding of the present invention can be obtained when the following detailed description of the preferred embodiment is considered in conjunction with the following drawings, in which:

FIG. 1 is a front view of the rough textured adhesive backed pad of the present invention;

FIG. 2 is a side view of the pad of FIG. 1;

FIG. 3 is a front view of the smooth textured adhesive backed pad of the present invention;

FIG. 4 is a side view of the pad of FIG. 3;

FIG. 5 is a front view of a molded, rough textured adhesive backed pad of the present invention;

FIG. 6 is an enlarged view taken along lines 6—6 of FIG. 5;

FIG. 7 is an enlarged view taken along lines 7—7 of FIG. 5;

FIG. 8 is a front view of a rubber textured adhesive backed pad of the present invention;

FIG. 9 is a front view of a molded rough textured adhesive backed pad of the present invention;

FIG. 10 is an enlarged view taken along lines 10—10 of FIG. 9;

FIG. 11 is an enlarged view taken along lines 11—11 of FIG. 9;

FIG. 12 is a perspective view of a prior art golf club head;

FIG. 13 is a perspective view of the adhesive backed pad as partially installed on a golf club head;

FIG. 14 is a perspective view of the adhesive backed pad as generally installed on a golf club head; and FIG. 15 is a view taken along lines 15—15 of FIG. 14.

DETAILED DESCRIPTION OF PREFERRED EMBODIMENT

Referring now to the drawings in more detail, FIGS. 1 and 2 are front and side views, respectively, of a rough textured adhesive backed pad 10 for use on a golf club face 28 (FIG. 12). Similarly, FIGS. 3 and 4 are front and side views, respectively, of a smooth textured adhesive backed pad 10 for use most often on a driver or wood or a lower numbered iron. The smooth surface eliminates the friction normally found on the face of the drivers or long irons and thus tends to eliminate or minimize spin.

The pad 10 includes a back surface 12 and a ball contact surface 14. Applied to the back surface 12 is an adhesive coating 16. Preferably, the adhesive coating 16 includes a double-sided tape which adheres to the back surface 12. In operation, the adhesive coating 16 adheres the pad 10 to the club face 28 (FIG. 12). Alternatively, the adhesive coating 16 may include a rubber or an acrylic based bonding agent or any other suitable bonding agent that provides a temporary bond between the present invention and the club face 28.

As shown in FIG. 1, the ball contact surface 14 of the pad 10 is generally rough in texture. Preferably, the ball contact surface 14 includes micron sized tungsten carbide granules of varying shapes. As may be appreciated, a rough ball contact surface 14 may include aluminum oxide or other types of granules that are micron size and have the textured feel of a fine grit sandpaper. In operation, abrasive granules providing the best spin properties range in size from about a 36 grit sandpaper to about an 80 grit sandpaper.

Alternatively, as shown in FIG. 8, the ball contact surface 14 may include a rubber coated material. The rubber coated material has the rough textured feel of a fine grit sandpaper. In operation, the rubber coated material imparts backspin similar to that of tungsten carbide granules. The rubber coated material, however, does not scuff the ball like the tungsten carbide granules.

Alternatively, as shown in FIGS. 5–7, a rough ball contact surface 14 may include a plurality of horizontally spaced ribs 38. As shown in FIG. 6, each rib 38 includes a multitude of peaks 30 and valleys 32 connected by inclined surfaces 34 and horizontal surfaces 36. As shown, the inclined surface 34 connects a valley 32 to an adjacent peak 30 with a lower Y-value. Similarly, the horizontal surface 36 connects a peak 30 to an adjacent valley 32 with a greater X-value. In the preferred embodiment, the distance between a peak 30 and valley 32 along the x-axis is 1/32th of an inch. Similarly, as shown in FIG. 7, width of a rib 38 at a peak 30 is 1/32th of an inch. Preferably, the ribs 38 are made of plastic and are horizontally spaced such that the ribs 38 abut one another at the valley 32 positions. In operation, the ribs 38 provide backspin similar to that imparted by the tungsten carbide granules. The plastic ribs 38, however, are more durable and thus do not wear out as fast as the tungsten carbide granules. As can be appreciated, the ribs 38 may be made from materials other than plastic such as steel or aluminum.

Alternatively, as shown in FIGS. 9–11, a rough ball contact surface 14 may include a plurality of horizontally and vertically spaced pyramids 48. As shown in FIG. 9, the pyramids 48 generally include four triangular faces 46 having a common peak 42. As shown in FIGS. 10 and 11, each triangular face 46 includes two base points 44 and a peak 42. Typically, the distance between base points 44 is about 1/32th of an inch. Similarly, the vertical distance from a base point 44 to a peak 42 is 1/32th of an inch. Preferably, the pyramids 48 are made of plastic and horizontally spaced such that the pyramids 48 abut one another at the base points 44. As can be appreciated, the pyramids 48 may be made from materials other than plastic such as steel or aluminum.

As shown in FIG. 12, the prior art golf club 20 is represented by an iron with a substantially planar club face surface. The golf club 20, whether an iron or a wood, is typically a conventional golf club having a head 22 and a shank 24 connected to an elongated shaft 26. The club face 28 of the head 22 is generally planar and polygonal shaped, as defined by the vertical lines 27 and their intersection with the perimeter of the club head 22. Additionally, the club face 28 is horizontally grooved, as indicated by the lines 29. The grooves 29 are coextensive with the width of the club face 28 and vertically spaced throughout the medial portion of the club face 28.

As shown in FIG. 13, the pad 10 is applied to the golf club 20 by pressing the back surface 12, with the adhesive coating 16 previously applied to it (not shown), against the club face 28. In contrast, removal of the pad 10 is performed simply by peeling the pad 10 from the club face 28. FIGS. 14 and 15 show the pad 10 completely adhered to the club face 28 and in its operative position on the golf club 20.

The pad 10 can be made of varying roughness. Each individual pad of varying roughness will provide a different degree of backspin to accommodate fairway and green conditions, as well as varying golfer ability. In practice, a set of pads can be carried in a golf bag and the golfer can select and apply a particular pad roughness depending upon the shot he is facing and the desired backspin. Additionally, because the pads can be readily applied and removed from the golf club face, a golfer will not need to purchase additional expensive clubs to obtain the same frictional element as the pads provide. As may be appreciated, the more coarse the pad, the greater the backspin applied to a struck golf ball. On long approach shots to the green (typically 50 yards or more), however, a coarse grit pad may cause undesirable scuffing of the ball. Under such conditions, a golfer may use the rubberized nonskid pad which imparts sufficient backspin for long approach shots but does not cause scuffing of the ball.

The foregoing disclosure and description of the invention are illustrative and explanatory thereof, and various changes in the size, shape, and materials may be made without departing from the spirit of the invention.

What is claimed is:

1. A device for use on a golf club having a substantially planer club face surface for striking a golf ball comprising a two-sided removable pad, said pad having a ball contact surface on a first side which includes a plurality of ribs to impart back spin to the struck golf ball, each said rib having a multitude of peaks and valleys each said valley connecting to an adjacent peak by an inclined surface and to another adjacent peak by a horizontal surface, and said pad having an adhesive coating on a second side for temporary application to the golf club surface.

2. The device of claim 1 wherein said adhesive coating includes double-sided tape.

3. The device of claim 1 wherein said coating includes a rubber based bonding agent.

4. The device of claim 1 wherein said coating includes an acrylic based bonding agent.

5. The device of claim 1 wherein said first side of said pad includes a plurality of equally spaced pyramids, each said pyramid having a multitude of triangular faces, said triangular faces of each one pyramid having a common peak.

* * * * *